US012458148B1

(12) United States Patent
Pan

(10) Patent No.: US 12,458,148 B1
(45) Date of Patent: Nov. 4, 2025

(54) WATER FLOATING DEVICE

(71) Applicant: Jiajun Pan, Guangzhou (CN)

(72) Inventor: Jiajun Pan, Guangzhou (CN)

( * ) Notice: Subject to any disclaimer, the term of this patent is extended or adjusted under 35 U.S.C. 154(b) by 0 days.

(21) Appl. No.: 19/091,318

(22) Filed: Mar. 26, 2025

(51) Int. Cl.
*A47C 15/00* (2006.01)
*B63B 34/50* (2020.01)

(52) U.S. Cl.
CPC ..... *A47C 15/006* (2013.01); *B63B 34/50* (2020.02)

(58) Field of Classification Search
CPC ..... A47C 15/006; B63B 34/50
See application file for complete search history.

(56) References Cited

U.S. PATENT DOCUMENTS 6,045,423 A * 4/2000 Silvia ..... B63B 34/50 441/130
10,758,049 B2 * 9/2020 Cooper ..... A47C 27/081
2005/0026520 A1 * 2/2005 Howerton ..... A47C 15/006 441/132
2015/0017852 A1 * 1/2015 Rubey ..... G01N 33/56911 441/130

* cited by examiner

*Primary Examiner* — S. Joseph Morano
*Assistant Examiner* — Jovon E Hayes
(74) *Attorney, Agent, or Firm* — Birchwood IP

(57) ABSTRACT

A water floating device is provided, which is provided with a floating element and a leaning element, they are detachably connected by a fastener. The fastener includes a fixed seat and an insertion end, the water floating device can be stored without releasing air after use. A height of the leaning element can also be adjusted by the fastener to achieve an effect of adjusting an appropriate height of the seating space for people of different body types. The present application provides multiple solutions for fastening the fastener, which can be connected by a rope body or fastened by a buckle. The axis of the fixed seat and the insertion end are locked; thus, they are both kept in a non-movable and in a rotatable state, which has advantages of quick installation/disassembly, good fastening effect, convenient adjustment, easy storage, and storage without releasing air.

9 Claims, 24 Drawing Sheets

WATER FLOATING DEVICE

TECHNICAL FIELD

The present disclosure relates to the field of water supplies technologies, and in particular, to a water floating device.

BACKGROUND

The floating chair is a kind of water leisure supply, which is usually used in swimming pools, beaches or other water environments to enable people to rest, relax or enjoy the time on water. The floating chair is usually made of buoyancy materials, such as foam plastic, inflatable rubber or polyvinyl chloride (PVC). These materials can provide sufficient buoyancy to allow the chair to float on water, typically including a seat, leaning element, and handrails. Some designs may also be provided with additional features such as cup holders, sunshade holes, or storage bags to increase convenience and comfort of use.

In existing technology, the seat and leaning element are usually fixedly connected, and the height cannot be adjusted. Therefore, users of different body types need to choose different models of products according to their own situations. In addition, in existing products, the seat and leaning element are inseparable and usually connected. Therefore, in an inflated state, they cannot be stored flat and occupy a lot of space. If stored after deflation, the entire product needs to be re-inflated every time, which is very inconvenient.

SUMMARY

In response to the shortcomings of existing technology, the present disclosure provides a water floating device, which has advantages of quick installation/disassembly, good fastening effect, convenient adjustment, easy storage, and non-deflated storage, effectively solving the problems of existing technology.

The purpose of the present disclosure is achieved through the following technical solutions.

A water floating device, including a floating body, the floating body is provided with at least one floating element for providing buoyancy, and a support plate is provided at a lower end of the floating element for supporting buttocks and/or legs of a human body; a leaning element is detachably connected to the floating element for a user's back to lean on; the floating element and the leaning element are fixedly connected by a fastener, the fastener is detachable; when the floating body is not in use, the floating body can be disassembled to store the floating element, support plate, and leaning element flat; the floating element, support plate, and leaning element can form a seating space when activated, and the user can lean on the leaning element when riding; the buttocks and/or legs are placed on the support plate, and the buoyancy provided by the floating element is used to make the user float on the water surface, and the water flow can pass through the support plate; thereby achieving an effect of the user being able to both semi-float on the water surface and contacts with the water; the fastener is provided with a fixed seat and an insertion end, the insertion end can be configured to adjust a relative position between the leaning element and the floating element, so that the leaning element can undergo a height change relative to the floating element, thereby achieving an effect of accommodating user of different body types in the seating space; the user can adjust a height of the leaning element according to his actual needs;

where the insertion end can still undergo an angular deflection when in a state of being inserted into the fixed seat, the leaning element is caused to rotate relative to the floating element with the fastener as an axle centre, allowing the user to lean on the leaning element in a more natural posture.

In one embodiment, the floating element consists of a connection seat and handrails; the handrails are provided on two sides of the connection seat, and the user can lower his arms on the handrails to further relax his bodies. The two sides of the support plate are connected to bottom sides of the handrails, which facilitates an even transfer of the user's weight to the floating element and prevents it from tipping over during floating. A hollow area is provided between the support plate and the connection seat, which facilitates water flow into the seating space and allows a lower part of the user's body to be immersed in water.

In one embodiment, the floating element is composed of a connection seat and handrails, the handrails are provided on two sides of the connection seat for the user to hold hands, and the support plate is T-shaped;

where left and right sides of the support plate are connected to the bottom sides of the handrails;

where a bottom side of the support plate is connected to a bottom of the leaning element;

a hollow area is provided between the support plate and the floating element;

the support plate is T-shaped, a horizontal part transmits pressure generated by the user's weight to the handrails, and a vertical part transmits pressure generated by the user's weight to the leaning element, which is then transmitted to the connection seat through the leaning element, so that the pressure generated by the user's weight is evenly distributed on the floating element, ensuring that the floating element is balanced in force during use and can float smoothly on the water surface. The vertical part can also pull the leaning element to deflect it, rendering it easy for the leaning element to adjust its own angle according to the user's posture, ensuring a comfortable fit with the customer's back. The hollow area between the support plate and the floating element facilitates water flow into the seating space, allowing the lower part of the user's body to be immersed in water.

In one embodiment, the fixed seat is provided with at least one first sleeve and a connector, and the insertion end is provided with at least one second sleeve. When the insertion end is inserted into the fixed seat, that is, when the first sleeve is aligned with the second sleeve, the connector can connect the first sleeve and the second sleeve. The first sleeve and the second sleeve are only needed to be aligned and are inserted into the connector to complete the connection between the insertion end and the fixed seat, so that the leaning element is firmly installed on an inner wall of the connection seat, which has advantages of convenient and fast adjustment and good fixing effect.

In one embodiment, there are two or more first sleeves and second sleeves, the first sleeves that are located on the same straight line form the fixed seat, and the second sleeves that are located on the same straight line form the insertion end. Multiple points fixing are used to form a line segment fixing, thereby forming a tight connection between the leaning element and the floating element. This connection method allows the second sleeves to be rotated around the first sleeves, achieving a corresponding deflection of the leaning element with different back postures during use, rendering the user feel more comfortable. The first sleeves provided on the fixed seat and the second sleeves provided on the insertion end are staggered with each other, and when they are fastened, they are clamped into each other, further improving stability. After being fully inserted, they form a tube shape; a middle can be configured for a strip-shaped object to pass through, rendering the first sleeves and the second sleeves are on the same line, the two can only be rotated relative to each other and cannot move relative to each other through the strip-shaped object. There are one or more rows of insertion ends, and the number of rows of the insertion ends can be set according to actual needs. A connection between the insertion end at high position and the fixed seat will reduce the height of the leaning element, and vice versa.

In one embodiment, a top of the leaning element is further provided with one row of insertion ends, and the insertion ends are configured to further fix the leaning element during storage. That is; after disassembling the leaning element from the connection seat, it can be placed between two handrails. To further strengthen the fixation of the leaning element, the insertion end on the top surface of the leaning element can be placed into the fixed seat to complete the flat connection of the leaning element in a middle space of the floating element.

In one embodiment, the connector is a rope body, two ends of the rope body are provided with rope knots, the rope knots can be untied. The connector passes through a tubular structure formed by the fixed seat and the insertion end. The tubular structure is formed by splicing the first sleeve and the second sleeve. After the rope body is inserted into the tubular structure composed of the fixed seat and the insertion end, it can connect the fixed seat and the insertion end in series to form a fastening, so that fixed seat and the insertion end are on the same line and cannot be separated. A cross-sectional area of each of the rope knots is greater than a cross-sectional area of the first sleeve and the second sleeve. After the rope knots are tied, the rope knots cannot pass through the first sleeve and the second sleeve, thereby having a locking effect.

In one embodiment, the connector is a rope body, one end of the rope body is connected to an upper surface of the connection seat, which is a fixed connection and cannot be disassembled. The other end of the rope body is provided with a rope knot that can be untied. The connector passes through a tubular structure formed by the fixed seat and the insertion end. The tubular structure is formed by splicing the first sleeve and the second sleeve. After the rope body is inserted into the tubular structure composed of the fixed seat and the insertion end, the fixed seat and the insertion end can be connected in series to form a fastening, so that the fixed seat and the insertion end are on the same line and cannot be separated. A cross-sectional area of the rope knot is greater than a cross-sectional area of the first sleeve and the second sleeve. After the rope knot is tied, it cannot pass through the first sleeve and the second sleeve, thereby having a locking effect.

In one embodiment, the connector is a rope body, one end of the rope body is connected to an upper surface of the connection seat, which is a fixed connection and cannot be disassembled. The other end of the rope body is provided with a clamp member, an upper surface of the connection seat is further provided with a clamp column for the clamp member to be inserted. The rope body has elasticity, the connector passes through a tubular structure formed by the fixed seat and the insertion end. The tubular structure is formed by splicing the first sleeve and the second sleeve. After the rope body is inserted into the tubular structure formed by the fixed seat and the insertion end, the fixed seat and the insertion end can be connected in series to form a fastening, so that the fixed seat and the insertion end are on the same line and cannot be separated. Through the elastic characteristics of the rope body, when subjected to an external force, the rope body can be stretched, which is convenient for the clamp member to be inserted into the clamp column. After being inserted into the clamp column, the clamp member naturally clamps the clamp column under a tension of the rope body resetting, while generating resistance that prevents the rope body from restoring its original length, in a tight state, the rope body can tighten the first sleeve and the second sleeve to keep them at the same line state. A width of the clamp member is smaller than a diameter of the rope body, ensuring that the clamp member can move in the tubular structure.

In one embodiment, the connector is provided with a locking column and an insertion column. The locking column is provided in the first sleeve, and two ends of the locking column are provided with recesses. The insertion column is provided in the second sleeve, and two ends of the insertion column are provided with convex columns configured to be inserted into the recesses. By inserting the convex columns into the recesses, a connection between the locking column and the insertion column can be completed, that is, a connection between the first sleeve and the second sleeve where the locking column and the insertion column are located can be completed, achieving the effect of locking the leaning element on the connection seat. A bottom of one of the convex columns is provided with a spring, which has an automatic reset effect, that is, the convex columns can be moved when subjected to a corresponding pressure and can reset itself when not subjected to the external force. The convex columns are further connected to a buckle, and the second sleeve is provided with a slot for the buckle to be exposed, which facilitates the user to adjust positions of the convex columns through the buckle, which is easy to insert and remove the convex columns.

1. In terms of performance:
(1) the height of the leaning element can be adjusted to render it be suitable for people of different body types;
(2) the leaning element is designed to be detachable and can be stored in a middle of the floating element;
(3) this water floating device can be stored without releasing air, thereby forming a horizontal surface during storage;
(4) the leaning element can be quickly installed and have a deflection according to the back's posture after installation.
2. In terms of structural:
(1) multiple rows of insertion ends are provided to achieve a height adjustment of the leaning element;
(2) the connector has various designs, and manufacturers can choose different solutions according to actual needs;
(3) the first sleeve and the second sleeve are locked together through the connector, so that they cannot be separated and can rotate along an axis of the connector.

BRIEF DESCRIPTION OF DRAWINGS

In order to provide a clearer explanation of the technical solution of the embodiments of the present disclosure, a brief introduction will be given below to the accompanying drawings required for use in the embodiments. It should be understood that the following drawings only illustrate some embodiments of the present disclosure and should not be considered as limiting the scope. For those skilled in the art, other relevant drawings can be obtained based on these drawings without creative work.

Figure 1:
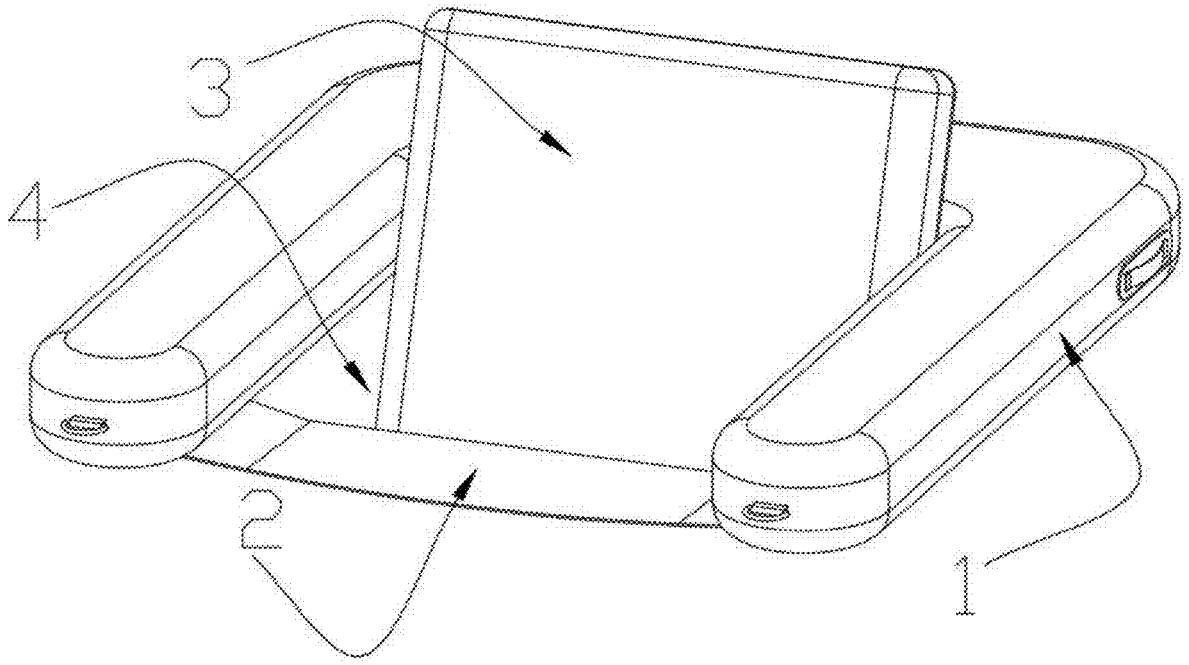
FIG. 1 is a first schematic structural diagram of a first form of the present disclosure.
Figure 2:
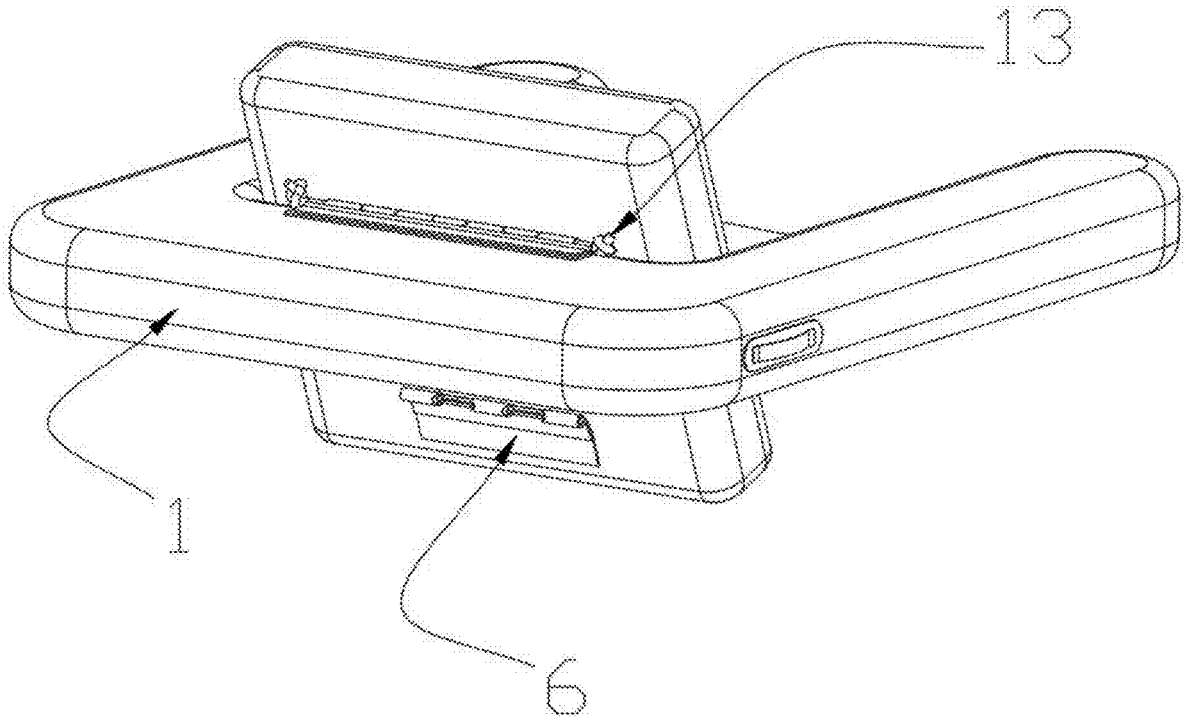
FIG. 2 is a second schematic structural diagram of the first form of the present disclosure.
Figure 3:
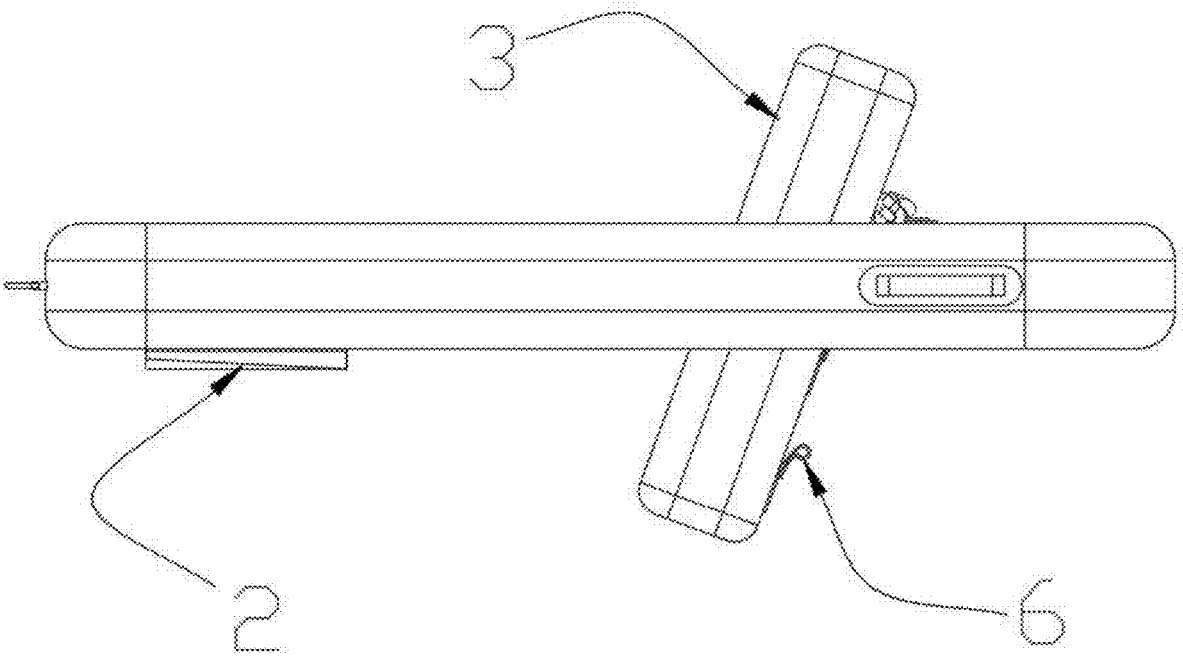
FIG. 3 is a side view of the first form of the present disclosure.
Figure 4:
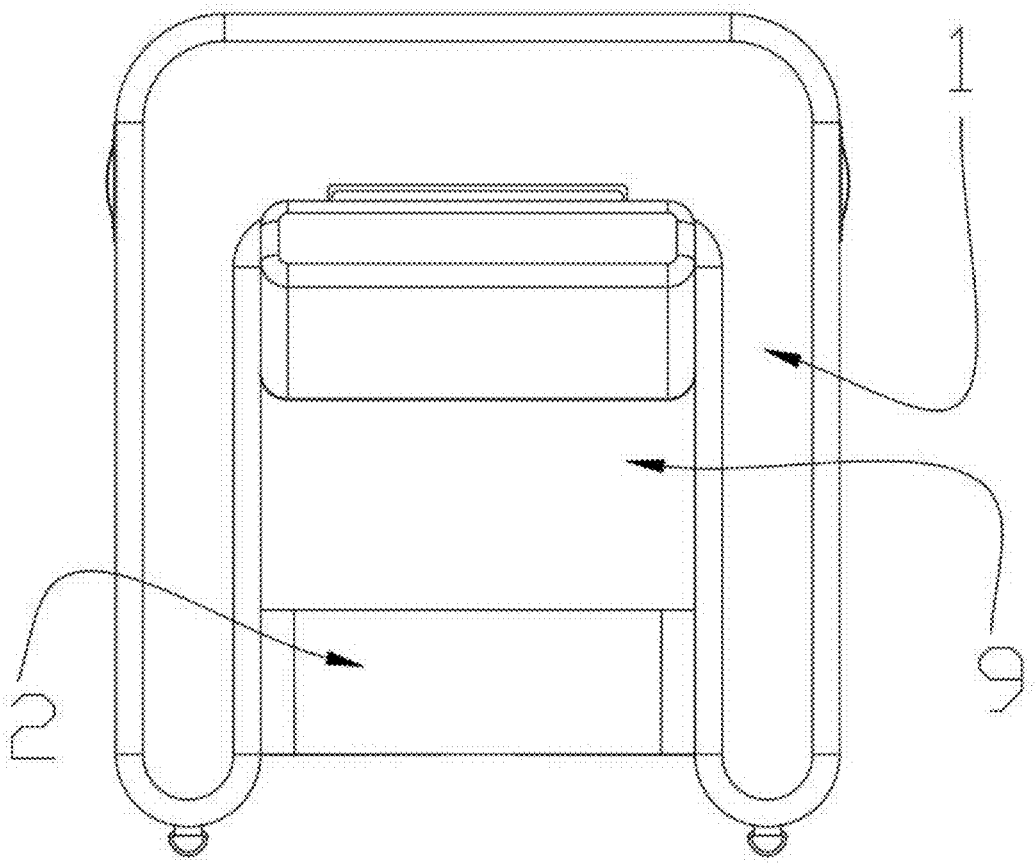
FIG. 4 is a top view of the first form of the present disclosure.
Figure 5:
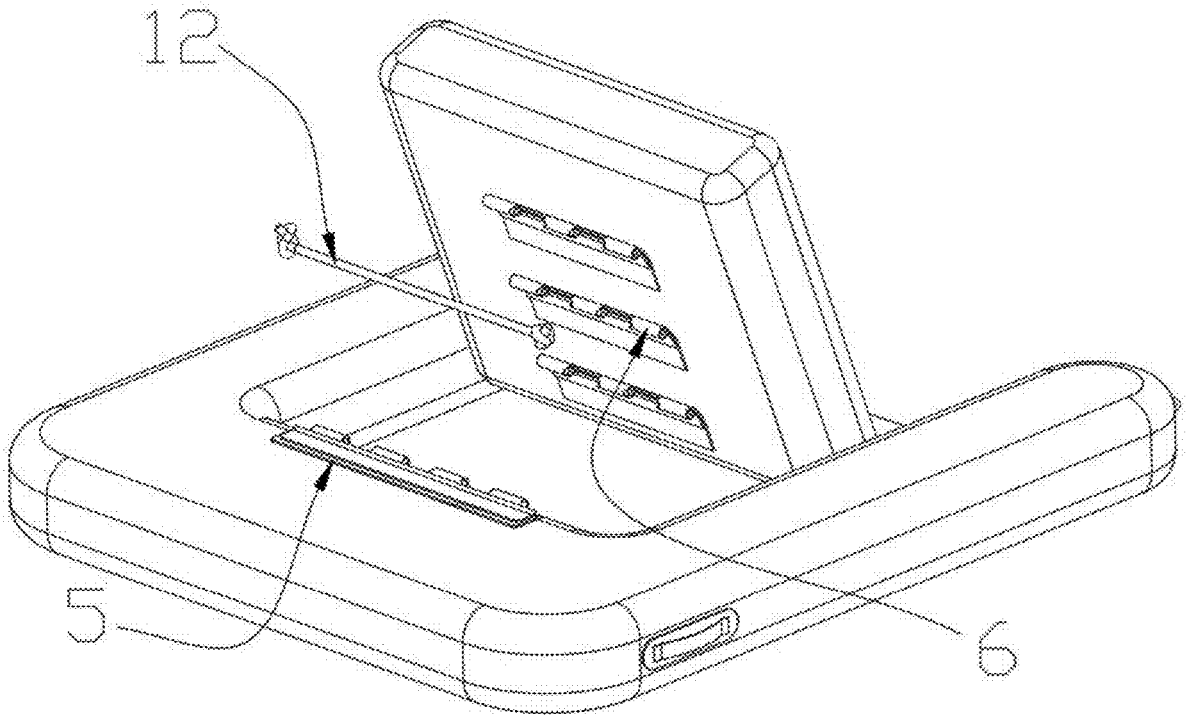
FIG. 5 is an exploded view of the first form of the present disclosure.
Figure 6:
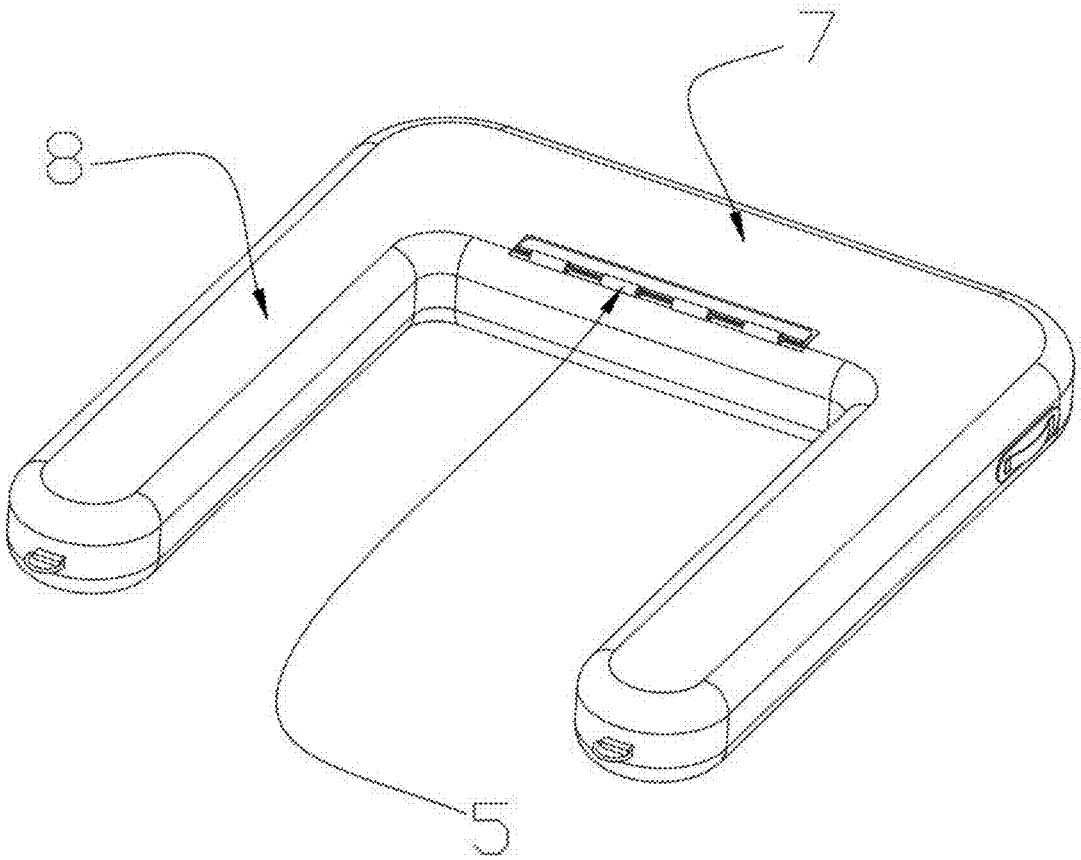
FIG. 6 is a schematic structural diagram of a floating element of the present disclosure.
Figure 7:
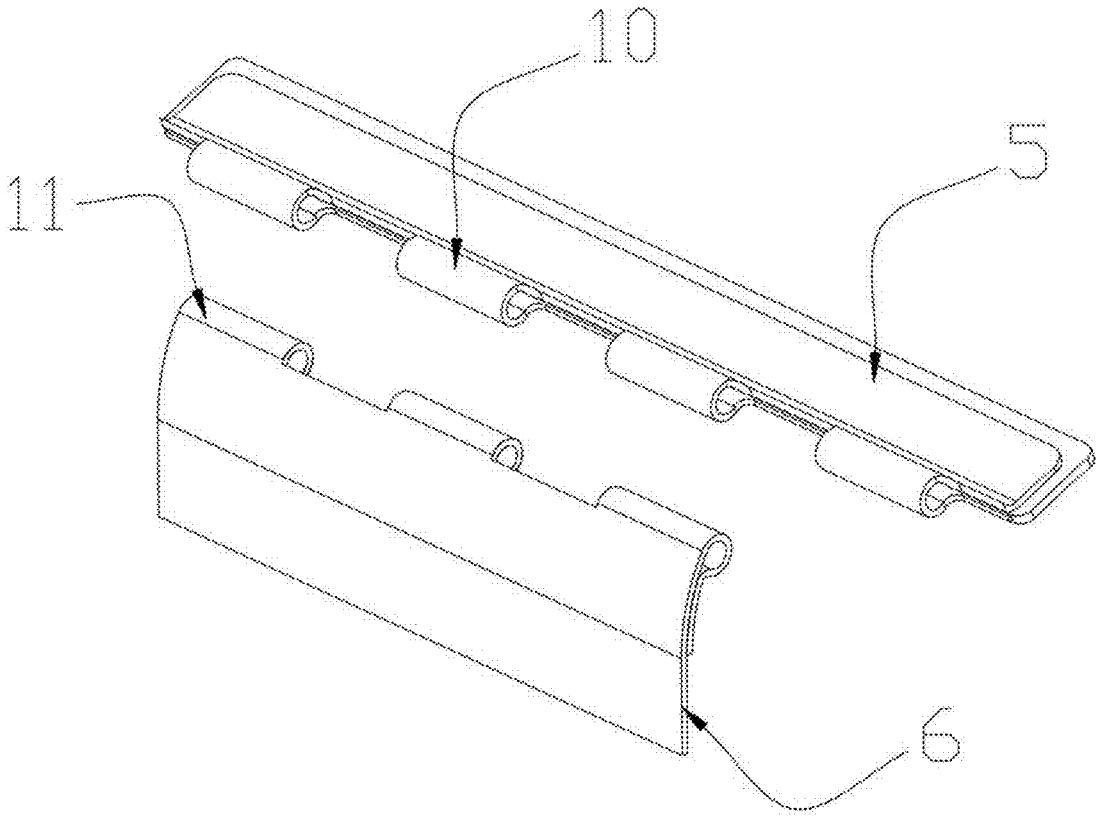
FIG. 7 is a schematic structural diagram of a fastener of the present disclosure.
Figure 8:
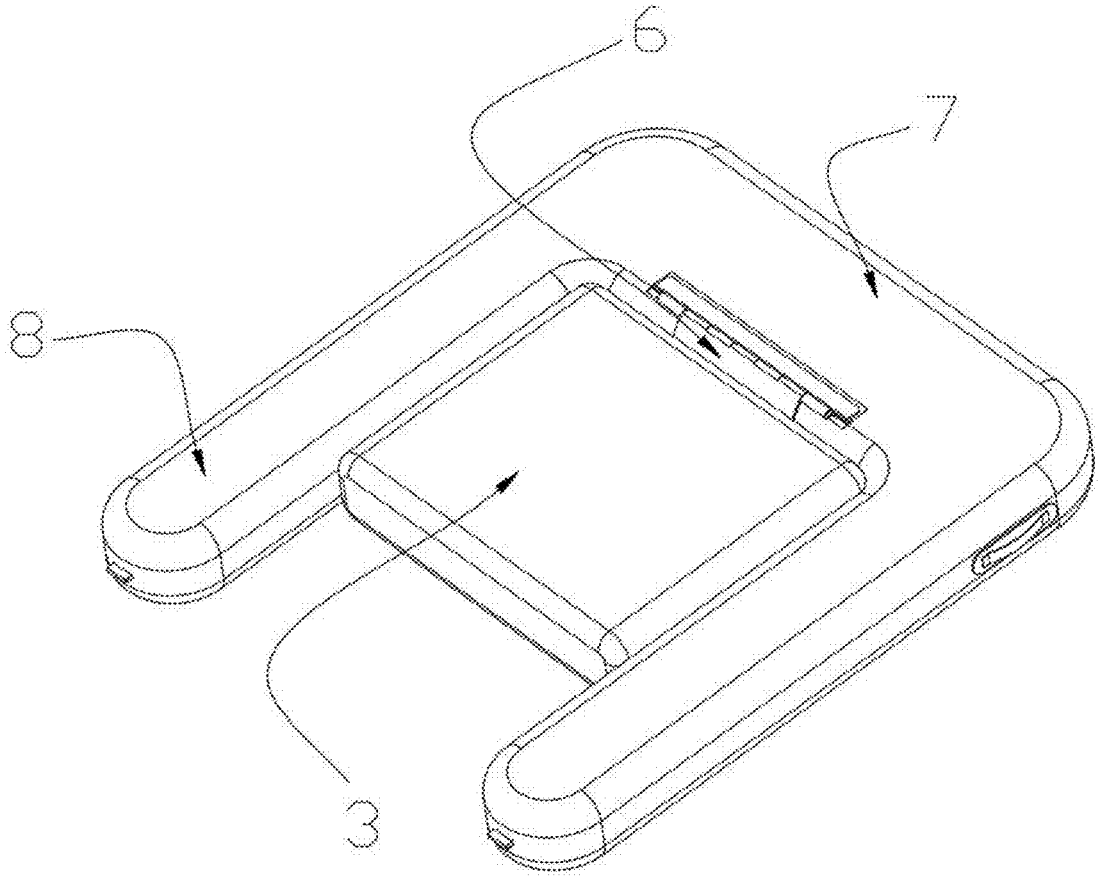
FIG. 8 is a storage state of a leaning element of the present disclosure.
Figure 9:
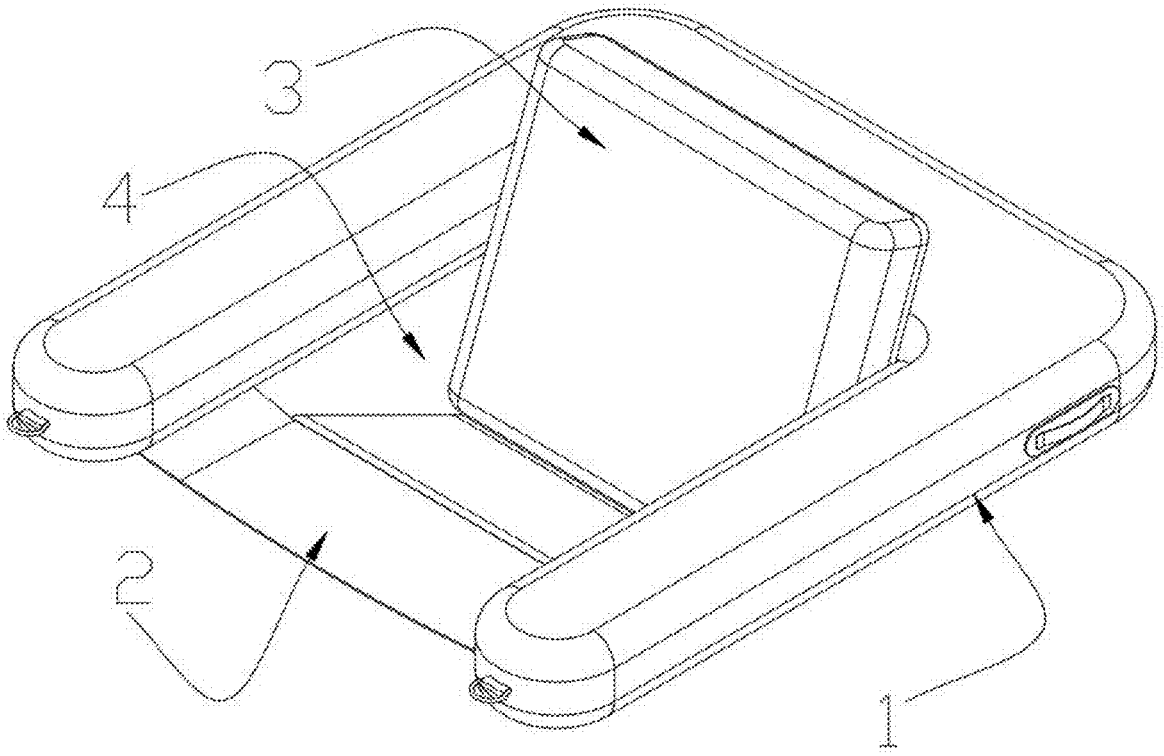
FIG. 9 is a first schematic structural diagram of a second form of the present disclosure.
Figure 10:
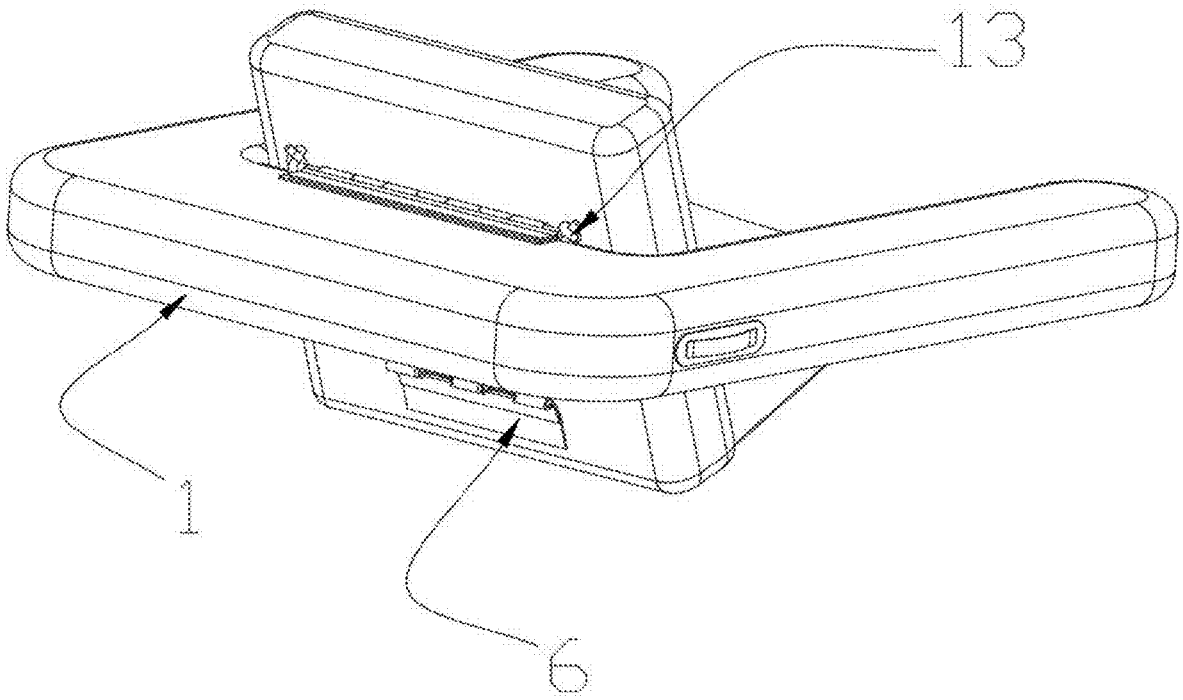
FIG. 10 is a second schematic structural diagram of the second form of the present disclosure.
Figure 11:
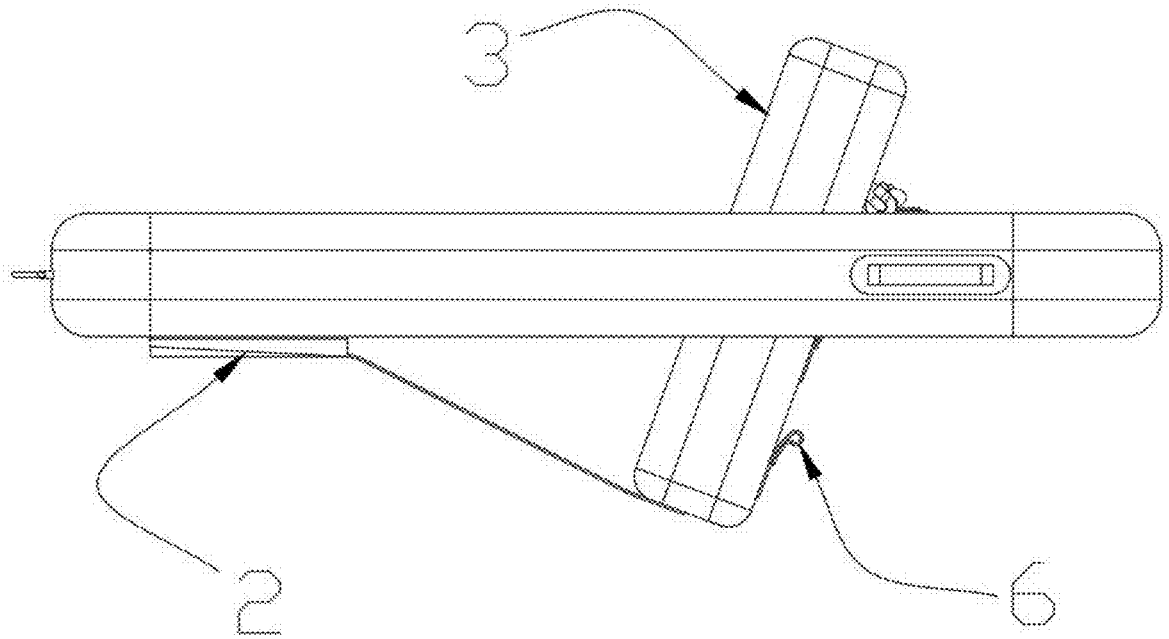
FIG. 11 is a side view of the second form of the present disclosure.
Figure 12:
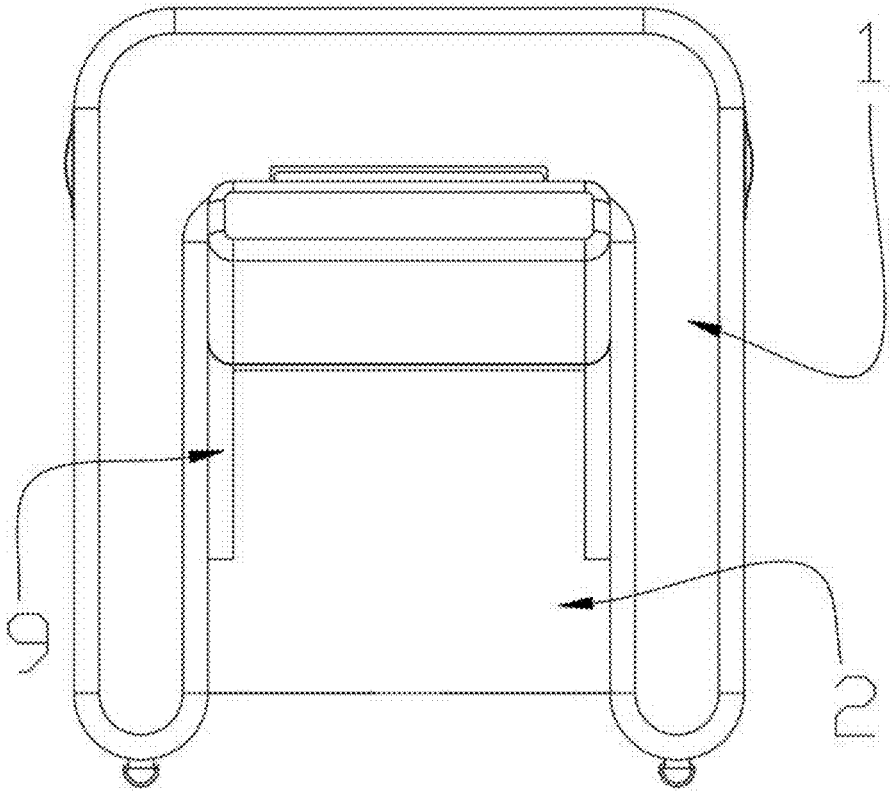
FIG. 12 is a top view of the second form of the present disclosure.
Figure 13:
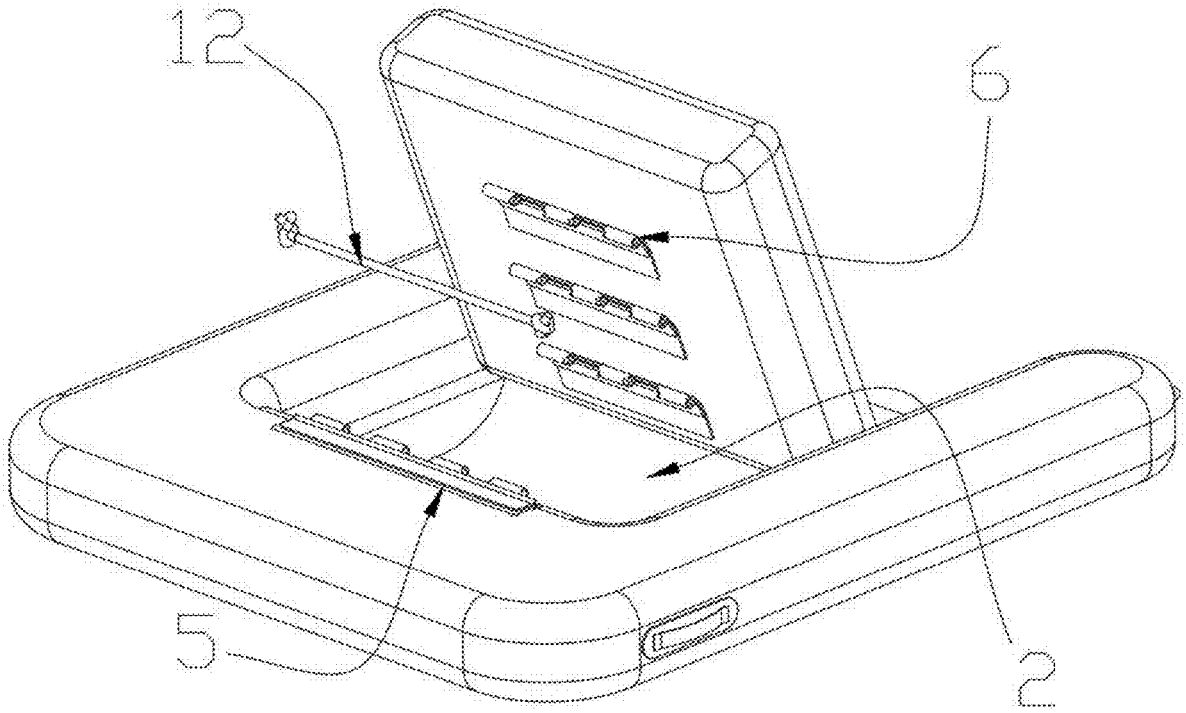
FIG. 13 is an exploded view of the second form of the present disclosure.

Numeral reference: floating element 1, support plate 2, leaning element 3, seating space 4, fixed seat 5, insertion end 6, connection seat 7, handrail 8, hollow area 9, first sleeve 10, second sleeve 11, rope body 12, rope knot 13, clamp member 14, clamp column 15, locking column 16, insertion column 17, recess 18, convex column 19, buckle 20.

DESCRIPTION OF EMBODIMENTS

In the following description, only some exemplary embodiments are briefly described. As understood by those skilled in the art, the described embodiments can be modified in various ways without departing from the spirit or scope of the present disclosure. Therefore, the figures and descriptions are considered to be exemplary rather than limitation.

In the description of the present disclosure, it should be understood that terms "up", "down", "front", "back", "left", "right", "top", "bottom", "inside", "outside" and other directional or positional relationships indicated are based on the directional or positional relationships shown in the accompanying drawings, only for a convenience of describing the present disclosure and simplifying the description, and do not indicate or imply that the device or element referred to must have a specific orientation, be constructed and operated in a specific orientation, and therefore cannot be understood as a limitation of the present disclosure.

In addition, terms "first" and "second" are only used for descriptive purposes and cannot be understood as indicating or implying relative importance or implying the number of technical features indicated. Thus, features referred to "first" and "second" may explicitly or implicitly include one or more of these features. In the description of the present disclosure, "multiple" means two or more, unless otherwise specifically limited.

In the present disclosure, unless otherwise specified and limited, terms "installation", "connection to", "connection with", "fixation", etc. should be broadly understood, for example, it can be a fixed connection, a detachable connection, or an integrate connection; it can be a mechanical connection, an electrical connection, or communication; it can be directly connected or indirectly connected through an intermediate medium, and it can be a connection within two components or an interaction relationship between two components. For those skilled in the art, specific meanings of the above terms in the present disclosure can be understood according to a specific situation.

Below, the embodiments of the present disclosure will be described in detail with reference to the accompanying drawings.

Please refer to FIGS. 1-8: a water floating device, including a floating body, the floating body is provided with at least one floating element 1; a lower end of the floating element 1 is provided with a support plate 2. The floating element 1 is detachably connected to a leaning element 3; the floating element 1 and the leaning element 3 are fixedly connected by a fastener. The floating element 1, the support plate 2, and the leaning element 3 form a seating space 4. When in use, the leaning element 3 is provided on the floating element 1 to complete an assembly of the floating body. The floating body is placed in water, and a user sits/semi lies on the support plate 2, his back is leaned on the leaning element 3, which can achieve leisure on the water. The fastener is provided with a fixed seat 5 and an insertion end 6, and the fixed seat 5 and the insertion end 6 can be aligned with each other to complete the installation, which is simple and fast. The insertion end 6 can be configured to adjust a relative position between the leaning element 3 and the floating element 1, so that the leaning element 3 undergoes a height change relative to the floating element 1, thereby achieving an effect of accommodating users of different body types in the seating space 4.

The insertion end 6 can still undergo an angular deviation when placed in the fixed seat 5, the leaning element 3 is caused to rotate relative to the floating element 1 with the fastener as an axis center. Due to an angular deviation of the leaning element 3, the user can adjust his back to a more comfortable posture by himself, which reduces a restriction of the leaning element 3 on user's posture.

In an implementation mode, the floating element 1 is composed of a connection seat 7 and handrails 8. The handrails 8 are provided on two sides of the connection seat 7, and the two sides of the support plate 2 are connected to bottom sides of the handrails 8. A hollow area 9 is provided between the support plate 2 and the connection seat 7.

By adopting the above technical solution, the support plate 2 is in a straight shape and is not connected to the leaning element 3. Water can directly enter the seating space 4 from the hollow area 9, allowing the user to immerse part of his torso in water during use, thereby achieving the effect of leisure and entertainment on the water surface.

In an implementation mode, the fixed seat 5 is provided with at least one first sleeve 10 and a connector, and the insertion end 6 is provided with at least one second sleeve 11. When the insertion end 6 is inserted into the fixed seat 5, that is, when the first and second sleeves 10 and 11 are aligned, the connector can connect the first and second sleeves 10 and 11.

By adopting the above technical solution, when it is necessary to install the leaning element 3 on the floating element 1, only the insertion end 6 needs to be inserted into the fixed seat 5, that is, the first sleeve 10 is aligned with the second sleeve 11, and then the connector is inserted to fasten the two. The connector only limits the first sleeve 10 and the second first sleeve 11 to be in the same straight line, they cannot be separated, and does not limit the second sleeve 11 to rotate relative to the first sleeve 10. Therefore, the leaning element 3 can be deflected.

In an implementation mode, a top of the leaning element 3 is further provided with one row of insertion ends 6.

By adopting the above technical solution, when it is necessary to store the leaning element 3, the insertion end 6 at a back of the leaning element 3 is separated from the fixed seat 5, a head of the leaning element 3 is facing the fixed seat 5, and the insertion end 6 at the top of the leaning element 3 is inserted into the fixed seat 5. A thickness of the leaning element 3 can be set to be the same as that of the floating element 1 to ensure that they can form a horizontal plane during storage.

In an implementation mode, the connector is a rope body 12, and two ends of the rope body 12 are provided with rope knots 13. The connector passes through a tubular structure formed by the fixed seat 5 and the insertion end 6 and fastens the fixed seat 5 and the insertion end 6. A cross-sectional area of one of the rope knots 13 is greater than a cross-sectional area of the first sleeve 10 and the second sleeve 11.

By adopting the above technical solution, when installing the leaning element 3, the rope knot 13 is tied to one end of the rope body 12, and the other end of the rope body 12 does not have rope knot. The insertion end 6 is placed into the fixed seat 5, so that the first sleeve 10 is aligned with the second sleeve 11. Then, the rope body 12 is inserted from one side of the fixed seat 5, the rope body 12 penetrates all the first and second sleeves 10 and 11, and then a rope knot is tied to the other side of the fixed seat 5. When disassembling, the rope knot 13 is simply untied on one side and it is pulled out from the other side. The steps for storing the leaning element 3 are the same, and will not be repeated here.

Please refer to FIGS. 6-13: a water floating device, including a floating body, where the floating body is provided with at least one floating element 1; a lower end of the floating element 1 is provided with a support plate 2. The floating element 1 is detachably connected to a leaning element 3, and a fixed connection is formed between the floating element 1 and the leaning element 3 through a fastener. The floating element 1, the support plate 2, and the leaning element 3 form a seating space 4. When in use, the leaning element 3 is installed on the floating element 1 to complete an assembly of the floating body. The floating body is placed in water, and a user sits/semi lies on the support plate 2, his back is leaned on the leaning element 3, which can achieve leisure on the water. The fastener is provided with a fixed seat 5 and an insertion end 6, the fixed seat 5 and the insertion end 6 can be aligned with each other to complete the installation, which is simple and fast. The insertion end 6 can be configured to adjust a relative position between the leaning element 3 and the floating element 1, so that the leaning element 3 undergoes a height change relative to the floating element 1, thereby achieving an effect of accommodating users of different body types in the seating space 4.

In an implementation mode, the floating element 1 is composed of a connection seat 7 and handrails 8, where the handrails 8 are provided on two sides of the connection seat 7, and the support plate 2 is T-shaped;

- left and right sides of the support plate 2 are connected to bottom sides of the handrails 8;
- a bottom side of the support plate 2 is connected to a bottom of the leaning element 3;
- a hollow area 9 is provided between the support plate 2 and the floating element 1.

By adopting the above technical solution, the support plate 2 is T-shaped and connected to the leaning element 3. Water can directly enter the seating space 4 from the hollow area 9, allowing the user to immerse part of his torso in water during use, thereby achieving the effect of leisure and entertainment on the water surface. As the support plate 2 is connected to the leaning element 3, when the user's torso is attached to the support plate 2, the leaning element 3 will also deflect, thereby causing a longitudinal side of the support plate 2 and the leaning element 3 to be attached along a curvature of the user's back, allowing the user's back to naturally lean on the support plate 2 and the leaning element 3.

In an implementation mode, the fixed seat 5 is provided with at least one first sleeve 10 and a connector, and the insertion end 6 is provided with at least one second sleeve 11. When the insertion end 6 is inserted into the fixed seat 5, that is, when the first sleeve 10 is aligned with the second sleeve 11, the connector can connect the first sleeve 10 and the second sleeve 11.

By adopting the above technical solution, when it is necessary to install the leaning element 3 on the floating element 1, only the insertion end 6 needs to be inserted into the fixed seat 5, that is, the first sleeve 10 is aligned with the second sleeve 11, and then the connector is inserted to fasten the first sleeve 10 and the second sleeve 11. The connector only limits the first sleeve 10 and the second sleeve 11 to be in the same straight line, they cannot be separated and does not limit the second sleeve 11 to rotate relative to the first sleeve 10. Therefore, the leaning element 3 can be deflected.

In an implementation mode, there are two or more first sleeves 10 and second sleeves 11. The first sleeves 10 that are located on the same straight line form the fixed seat 5, and the second first sleeves 11 that are located on the same straight line form the insertion end 6. The first sleeves 10 provided on the fixed seat 5 and the second sleeves 11 provided on the insertion end 6 are staggered with each other, thereby forming a tubular shape when fully inserted. There are one or more rows of insertion ends 6.

By adopting the above technical solution, there is only one fixed seat 5, and there are a plurality of rows of insertion ends 6. The insertion ends 6 with different heights can be placed on the fixed seat 5 as needed to adjust the height of the leaning element 3. The number of the first sleeves 10 is one more than the number of the second sleeves 11, so that adjacent two first sleeves 10 clamp the second sleeves 11 in a clamping state, ensuring that the force received by the leaning element 3 and the floating element 1 can be evenly transmitted to the connector, thereby preventing uneven force and causing them to detach.

In an implementation mode, a top of the leaning element 3 is further provided with one row of insertion ends 6.

By adopting the above technical solution, when it is necessary to store the leaning element 3, the insertion end 6 on a back of the leaning element 3 is separated from the fixed seat 5, a head of the leaning element 3 is facing the fixed seat 5, and the insertion end 6 on the top of the leaning element 3 is inserted into the fixed seat 5. A thickness of the leaning element 3 can be set to be the same as that of the floating element 1 to ensure that they can form a horizontal plane during storage. To facilitate the storage of the support plate 2, a Velcro A surface can be provided on the back of the support plate 2, and a Velcro B surface can be provided under the last row of the insertion ends 6 on the back of the leaning element 3. After tightening the longitudinal side of the support plate 2, the Velcro A can be perfectly attached to the Velcro B surface.

In an implementation mode, the connector is a rope body 12, and two ends of the rope body 12 are provided with rope knots. The connector passes through a tubular structure formed by the fixed seat 5 and the insertion end 6 and fastens the fixed seat 5 and the insertion end 6. A cross-sectional area of one of the rope knots 13 is greater the than that of the first sleeve 10 and second sleeve 11.

By adopting the above technical solution, when installing the leaning element 3, a rope knot 13 is tied to one end of the rope body 12, and the other end of the rope body 12 is not tied with a rope knot 13. The insertion end 6 is placed into the fixed seat 5, so that the first sleeve 10 is aligned with the second sleeve 11. Then, the rope body 12 is inserted from one side of the fixed seat 5, the rope body 12 penetrates all the first and second sleeves 10 and 11, and then the rope knot is tied on the other side of the fixed seat 5. When disassembling, the rope knot 13 is only untied on one side and it is pulled out from the other side. The steps for storing the leaning element 3 are the same, and will not be repeated here.

Figure 14:
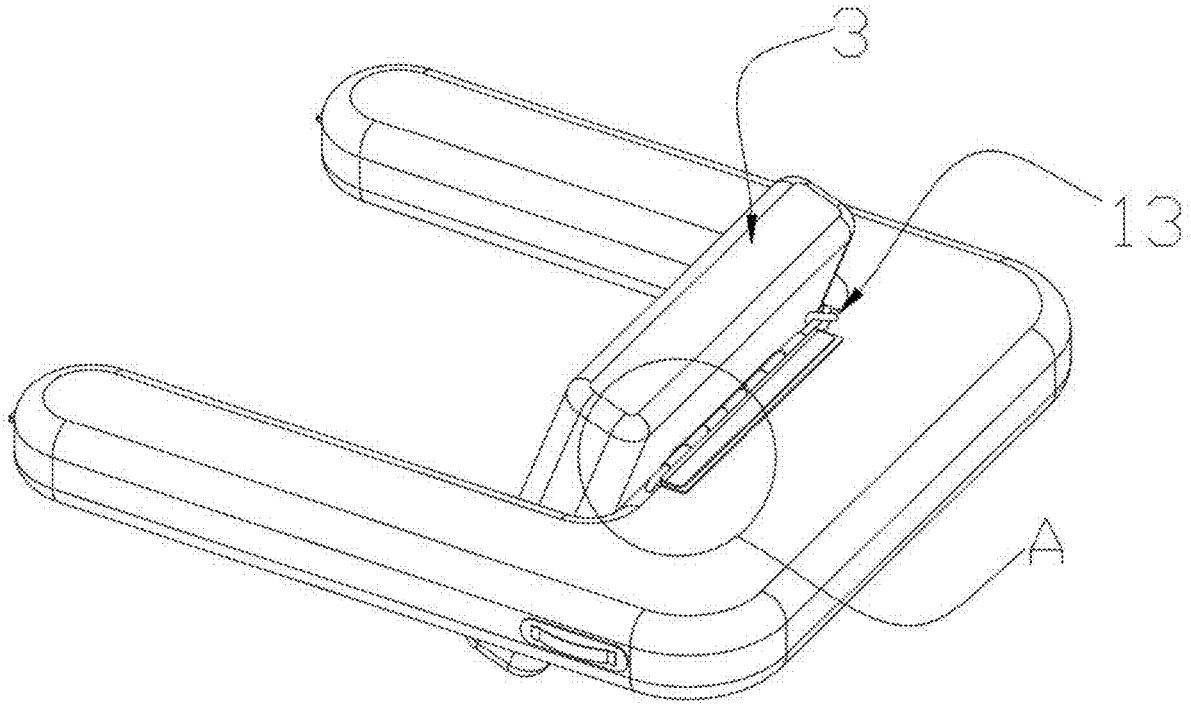
FIG. 14 is a second schematic structural diagram of the floating element of the present disclosure.
Figure 15:
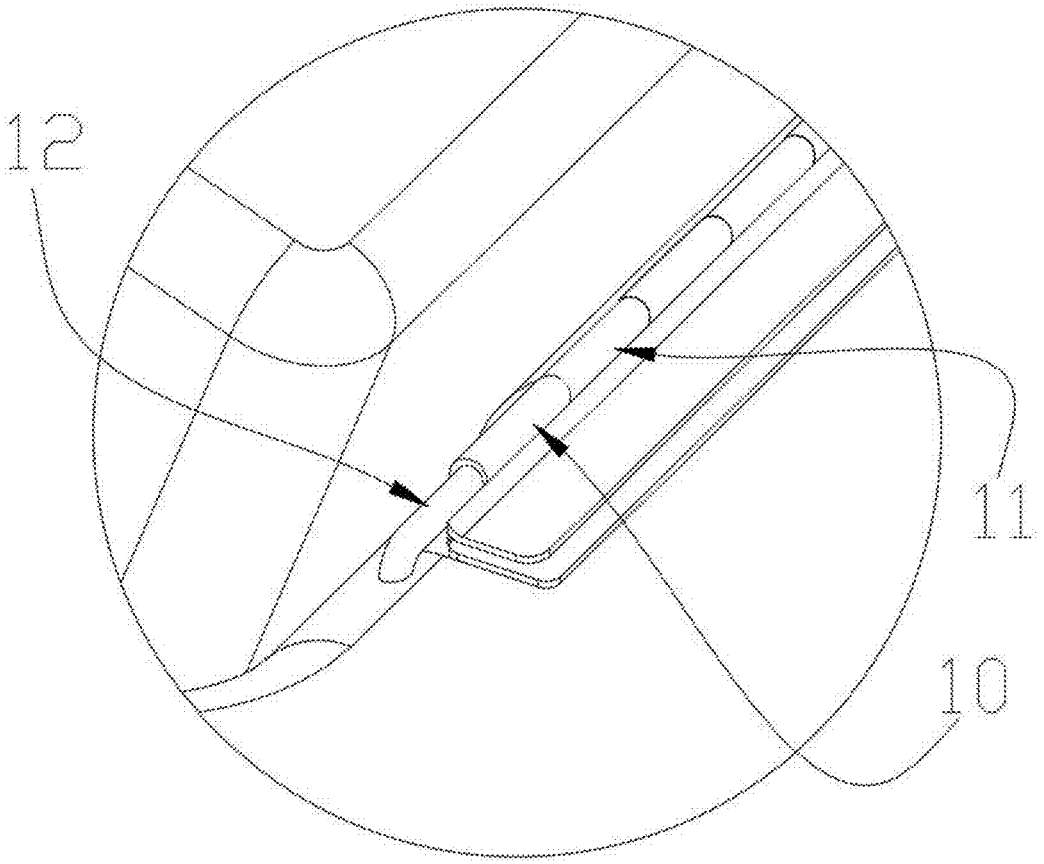
FIG. 15 is an enlarged view of point A in FIG. 14 of the present disclosure.

Please refer to FIGS. 14-15: this application further provides a solution for fixing one end of the rope body 12 on the connection seat 7.

In an implementation mode, the connector is a rope body 12, one end of the rope body 12 is connected to an upper surface of the connection seat 7, and the other end of the rope body 12 is provided with a rope knot 13. The connector passes through a tubular structure formed by the fixed seat 5 and the insertion end 6 and fastens the fixed seat 5 and the insertion end 6. A cross-section of the rope knot 13 is greater than that of the first sleeve 10 and the second sleeve 11.

By adopting the above technical solution, when installing the leaning element 3, the insertion end 6 is firstly placed into the fixed seat 5, the first sleeve 10 is aligned with the second sleeve 11. Then, a movable end of the rope body 12 is inserted into the rope body 12 from one side of the fixed seat 5, so that the rope body 12 penetrates all the first sleeve 10 and the second sleeve 11. Then, the other side of the fixed seat 5 is tied with one rope knot. When disassembling, the side with the rope knot 13 is simply untied and the rope body 12 is extracted from the other side to separate the leaning element 3 from the floating element 1. The steps for storing the leaning element 3 are also the same, which will not be repeated here.

Figure 16:
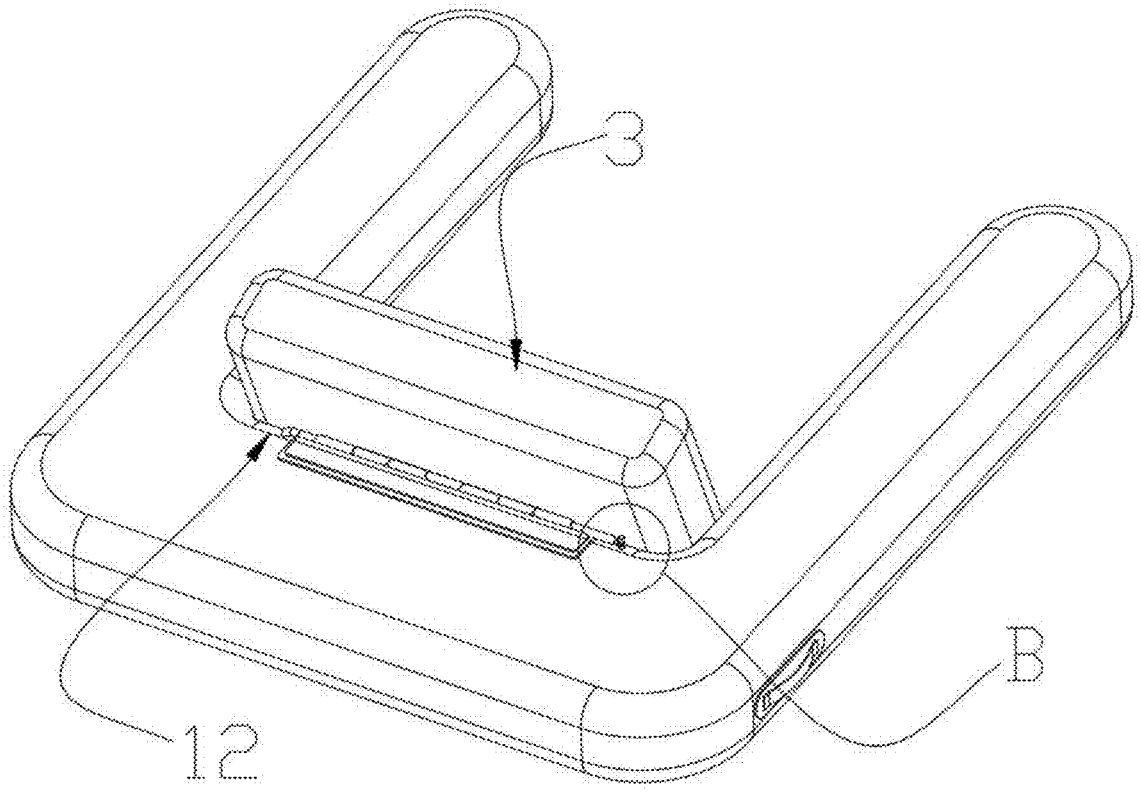
FIG. 16 is a third schematic structural diagram of the floating element of the present disclosure.
Figure 17:
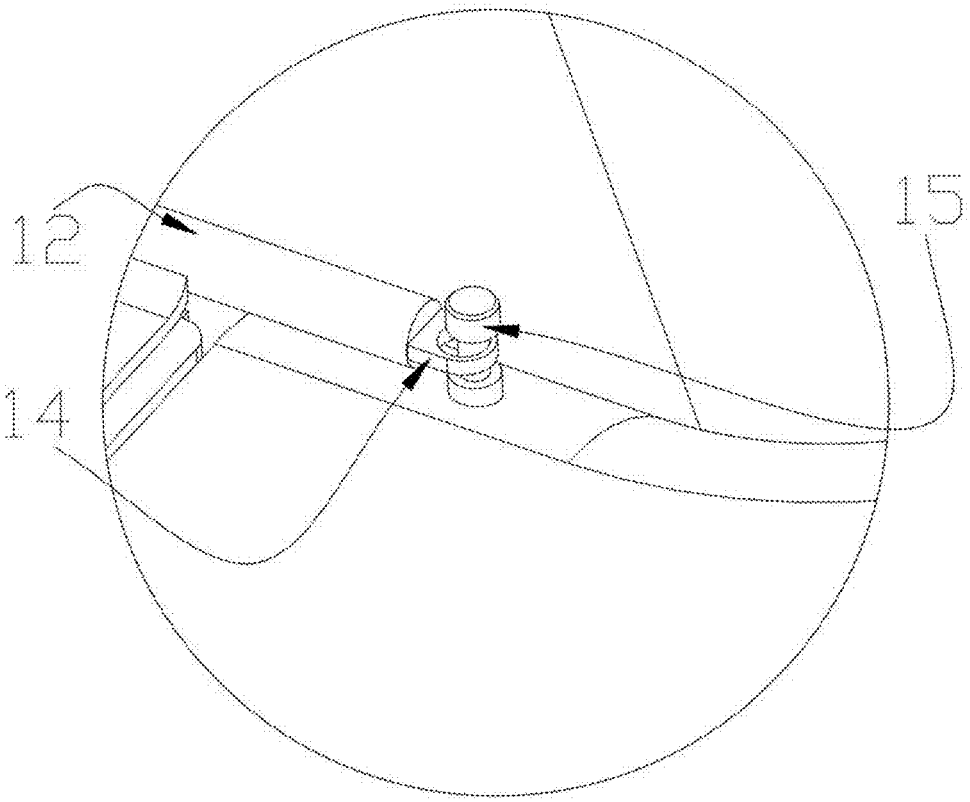
FIG. 17 is an enlarged view of point B in FIG. 16 of the present disclosure.
Figure 18:
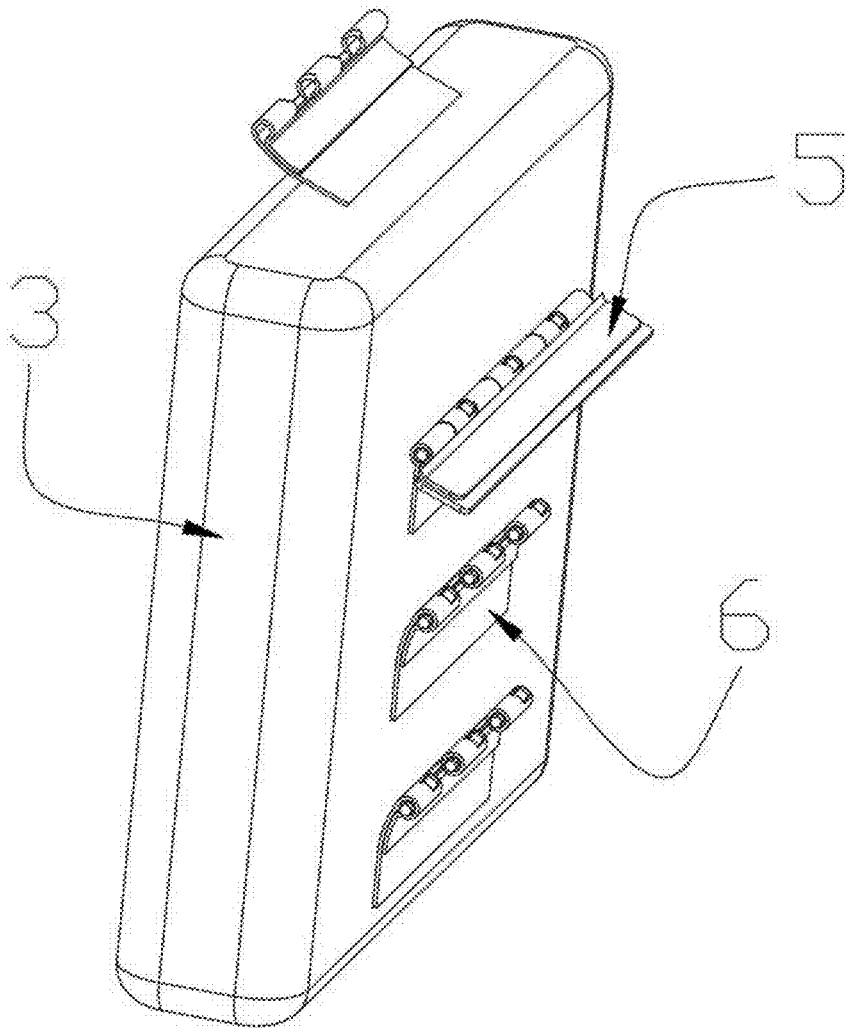
FIG. 18 is a schematic structural diagram of a leaning element of the present disclosure.
Figure 19:
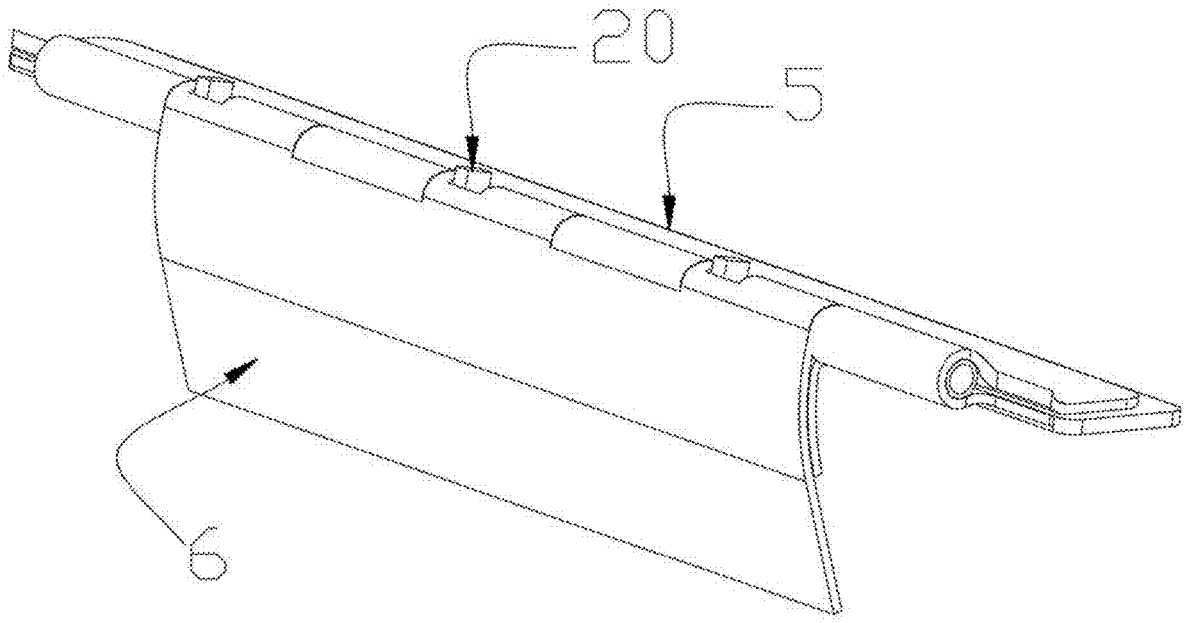
FIG. 19 is a second schematic structural diagram of the fastener of the present disclosure.
Figure 20:
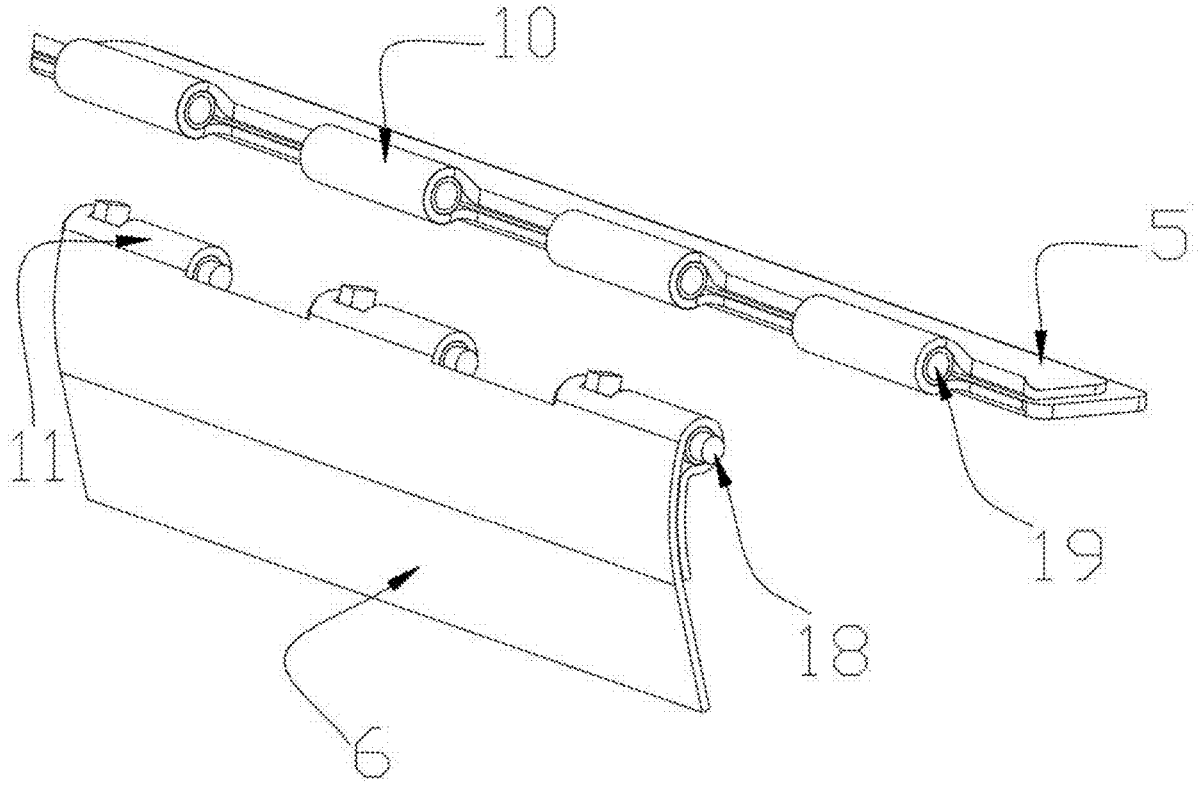
FIG. 20 is a third schematic structural diagram of the fastener of the present disclosure.
Figure 21:
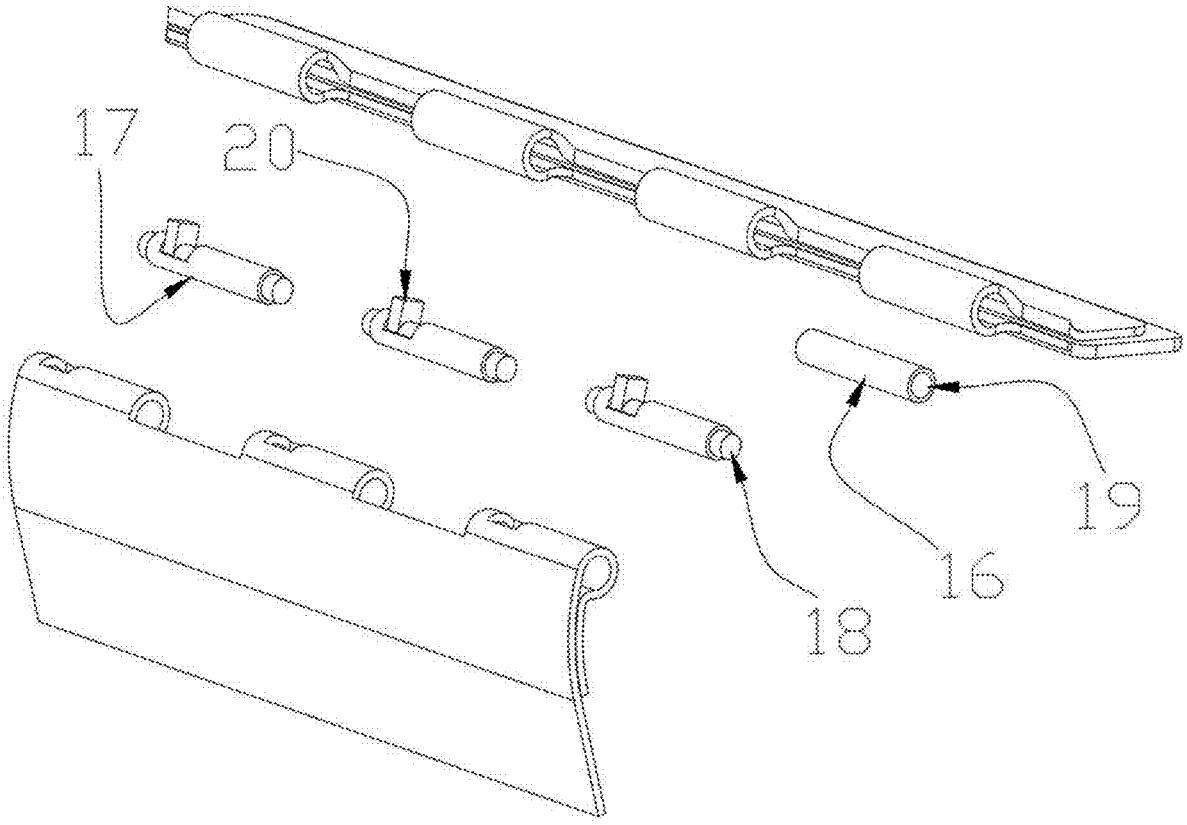
FIG. 21 is an exploded structural view of the fastener of the present disclosure.
Figure 22:
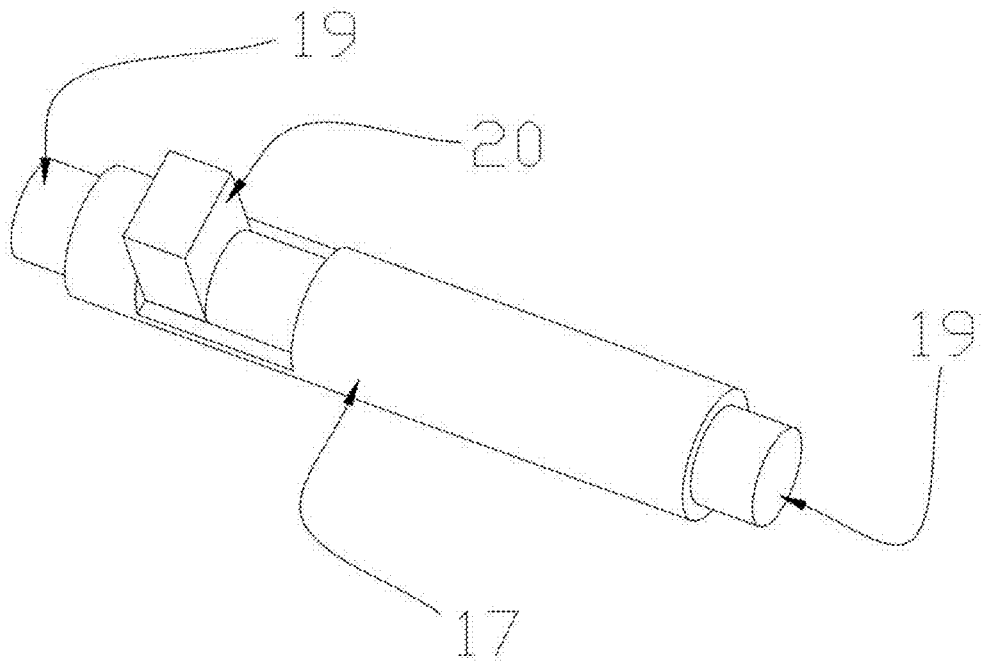
FIG. 22 is a schematic structural diagram of an insertion column of the present disclosure.
Figure 23:
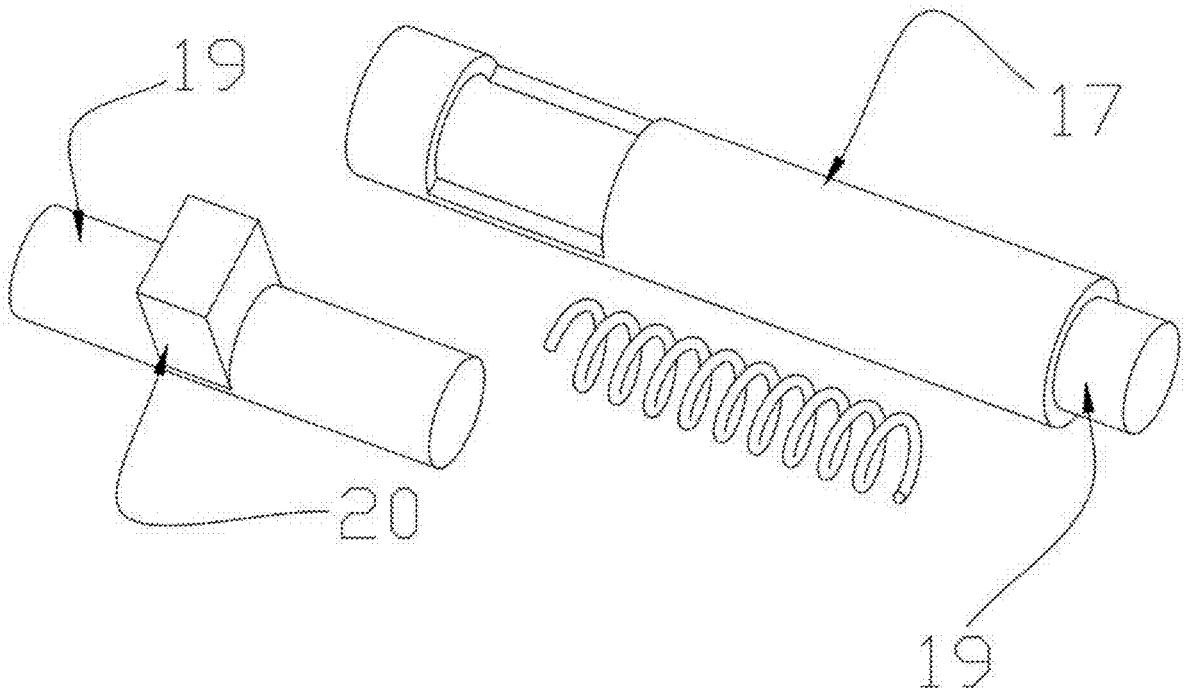
FIG. 23 is an exploded structural diagram of the insertion column of the present disclosure.

Please refer to FIGS. 16-17, this application further provides a scheme in which one end of the rope body 12 is fixed to the connection seat 7 and the other end of the rope body 12 is provided with a clamp member 14.

In an implementation mode, the connector is the rope body 12, one end of the rope body 12 is connected to an upper surface of the connection seat 7, and the other end of the rope body 12 is provided with the clamp member 14. An upper surface of the connection seat 7 is further provided with a clamp column 15 for the clamp member 14 to be inserted. The rope body 12 has elasticity, and the connector passes through a tubular structure formed by the fixed seat 5 and the insertion end 6 and fastens the fixed seat 5 and the insertion end 6. A width of the clamp member 14 is smaller than a diameter of the rope body 12.

By adopting the above technical solution, when installing the leaning element 3, the insertion end 6 is first placed into the fixed seat 5, so that the first sleeve 10 is aligned with the second sleeve 11. Then, one end of the rope body 12 provided with the clamp member 14 is inserted from one side of the fixed seat 5, and exposed from the other end, so that the rope body 12 penetrates all the first sleeves 10 and second sleeves 11. At this time, the user needs to exert force to pull the rope body 12 outward to extend the rope body 12, so that the clamp member 14 can be inserted into the clamp column 15, and there is a circular recess in a middle of the clamp column 15 for the clamp member 14 to be inserted. When the clamp member 14 is placed into the recess, it will naturally clamp the recess under a tension of a self-resetting of the rope body 12. An upper wall of the recess can limit the clamp member 14 from disengaging. When disassembling, the rope body 12 is simply pulled, so that an opening on the clamp member 14 is aligned with the clamp column 15, and the clamp member 14 can be detached from the recess on the clamp column 15. The clamp member 14 is moved upwards, the clamp member 14 can be separated from the clamp column 15, and finally the rope body 12 can be pulled out from the other side so as to separate the leaning element 3 from the floating element 1. The steps for storing the leaning element 3 are also the same, and will not be repeated here.

Please refer to FIGS. 18-23, this application further provides a solution without a rope body 12. This solution uses a locking column 16 and an insertion column 17 to achieve a detachable connection between the leaning element 3 and the floating element 1.

In an implementation mode, the connector is provided with the locking column 16 and the insertion column 17. The locking column 16 is provided in the first sleeve 10, and two ends of the locking column 16 are provided with recesses 18. The insertion column 17 is provided in the second sleeve 11, and two ends of the insertion column 17 are provided with convex columns 19 that are inserted into the recesses 18. A bottom of one of the convex columns 19 is provided with a spring, and the convex columns 19 are further connected to a buckle 20. The second sleeve 11 is provided with a slot for the buckle 20 to be exposed.

By adopting the above technical solution, when installing the leaning element 3, the insertion column 17 needs to be installed into the locking column 16. First, the convex column 19 on an immovable side of the insertion column 17 is placed into the recess 18, and then the buckle 20 is pushed inward with fingers, so that the convex column 19 on the movable side can be retracted into the insertion column 17 and compress the spring. When the movable convex column is completely retracted into the insertion column 17, the insertion column 17 can be completely inserted between two adjacent locking columns 16. The buckle 20 is released, and the spring can reset on its own without external force. The movable convex column 19 is pushed into the recess 18, and at this time, the insertion column 17 can be fixed between two adjacent locking columns 16. The above steps are repeated and all insertion columns 17 are installed into the locking column 16 to complete the installation of the leaning element 3. When disassembling, the buckle 20 is pushed inward again; the locking column 16 can be removed, and the steps for storing the leaning element 3 are the same, which will not be repeated here.

Figure 24:
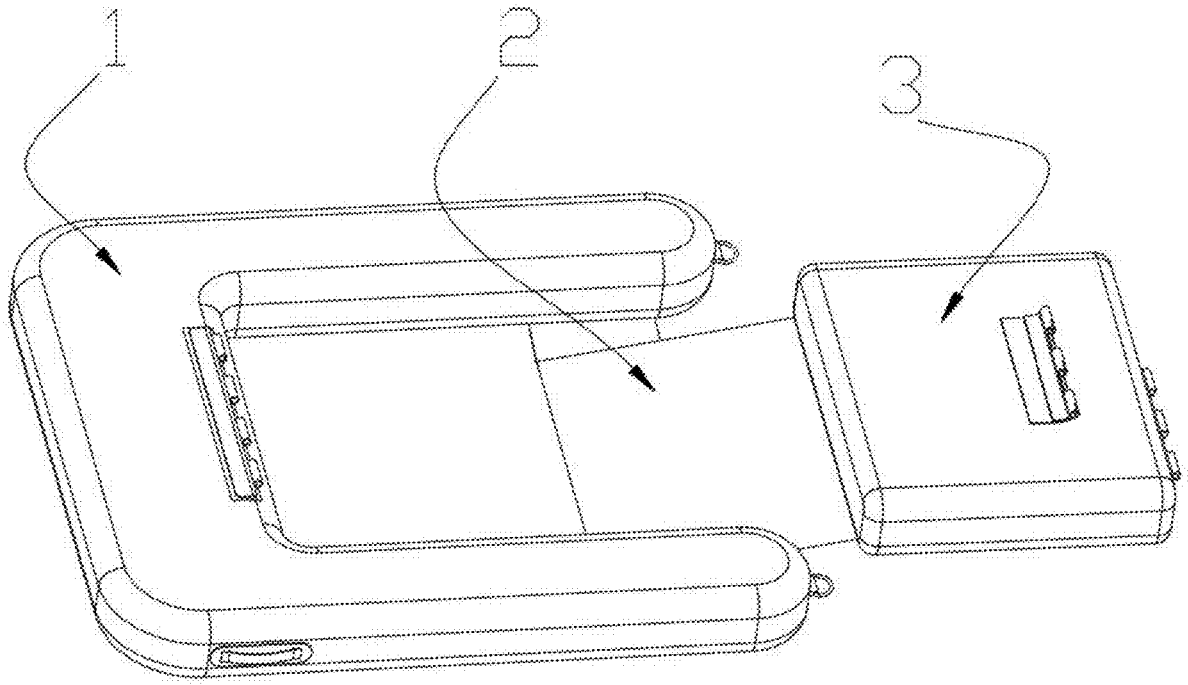
FIG. 24 is a schematic structural diagram of a footrest of the leaning element of the present disclosure.

Please refer to FIG. 24, the present application further provides a usage method of the leaning element 3 with foot placement function. In this embodiment, the leaning element 3 must be inflatable. Specific usage steps are to fold a longitudinal side of the support plate 2 upwards, so that it is stacked on a transverse side of the support plate. At this time, the position of the leaning element 3 is far away from the floating element 1, which can be used for the user to place his feet.

Working principle: by installing/removing the connector, the user can quickly install/remove the leaning element 3 and the floating element. There are a plurality rows of insertion ends 6, so that the height of the leaning element 3 can be adjusted according to the actual needs of the user. When storing, the insertion end 6 at the top of the leaning element 3 can also be bound to the floating element 1 for easy storage. The leaning element 3 can also serve as a floating board for the user to support his feet. The insertion end 6 and the fixed seat 5 are locked by axis centers of the two, so that they are non-movable and can be rotated.

The above embodiments only express some embodiments of the present disclosure, and his descriptions are more specific and detailed, but should not be understood as limiting the scope of the present disclosure. It should be noted out that for those skilled in the art, several modifications and improvements can be made without departing from the inventive concept, which are within the protection scope of the present disclosure. Therefore, the protection scope of the present disclosure should be based on the appended claims.

What is claimed is:

1. A water floating device, comprising a floating body, wherein the floating body is provided with at least one floating element, a lower end of the floating element is provided with a support plate;

the floating element is detachably connected to a leaning element, and a fixed connection is formed between the floating element and the leaning element through a fastener;

the floating element, the support plate, and the leaning element form a seating space, and the fastener is provided with a fixed seat and an insertion end;

the insertion end is configured to adjust a relative position between the leaning element and the floating element, and the leaning element is caused to undergo a height change relative to the floating element, thereby causing the seating space to be suitable for users of different body types;

wherein the insertion end undergoes an angular deflection when placed in the fixed seat, thereby causing the leaning element to be rotated relative to the floating element with the fastener as an axle centre;

wherein the floating element is composed of a connection seat and handrails, the handrails are provided on two sides of the connection seat, and the support plate is T-shaped;

wherein left and right sides of the support plate are connected to bottom sides of the handrails;

wherein a bottom side of the support plate is connected to a bottom of the leaning element;

a hollow area is provided between the support plate and the floating element.

2. The water floating device according to claim 1, wherein the floating element is composed of a connection seat and handrails, the handrails are provided on two sides of the connection seat, two sides of the support plate are connected to bottom sides of the handrails, and a hollow area is provided between the support plate and the connection seat.

3. The water floating device according to claim 1, wherein the fixed seat is provided with at least one first sleeve and a connector, and the insertion end is provided with at least one second sleeve;

when the insertion end is placed into the fixed seat, that is, when the first sleeve is aligned with the second sleeve, the connector is connected to the first sleeve and the second sleeve.

4. The water floating device according to claim 3, wherein there are two or more first sleeves and second sleeves, the first sleeves that are located on the same straight line form the fixed seat, and the second sleeves that are located on the same straight line form the insertion end;

the first sleeves provided on the fixed seat and the second sleeves provided on the insertion end are staggered with each other, and after they are completely inserted, they form a tube shape;

there are one or more rows of insertion ends.

5. The water floating device according to claim 4, wherein a top of the leaning element is further provided with one row of insertion ends.

6. The water floating device according to claim 5, wherein the connector is a rope body, and two ends of the rope body are provided with rope knots;

the connector passes through a tubular structure formed by the fixed seat and the insertion end and fastens the fixed seat and the insertion end, a cross-sectional area of each of the rope knots is greater than a cross-sectional area of the first sleeve and the second sleeve.

7. The water floating device according to claim 5, wherein the connector is a rope body, one end of the rope body is connected to an upper surface of the connection seat, and the other end of the rope body is provided with a rope knot;

the connector passes through a tubular structure formed by the fixed seat and the insertion end and fastens the fixed seat and the insertion end;

a cross-section of the rope knot is greater than a cross-sectional area of the first sleeve and the second sleeve.

8. The water floating device according to claim 5, wherein the connector is a rope body, one end of the rope body is connected to an upper surface of the connection seat, and the other end of the rope body is provided with a clamp member, an upper surface of the connection seat is further provided with a clamp column for the clamp member to be inserted, the rope body has elasticity;

the connector passes through a tubular structure formed by the fixed seat and the insertion end and fastens the fixed seat and the insertion end;

a width of the clamp member is smaller than a diameter of the rope body.

9. The water floating device according to claim 5, wherein the connector is provided with a locking column and an insertion column, the locking column is provided in the first sleeve, and two ends the locking column are provided with recesses, the insertion column is provided in the second sleeve, and two ends of the insertion column are provided with convex columns configured to be inserted into the recesses, wherein a bottom of one of the convex columns is provided with a spring, the convex columns are further connected to a buckle, and the second sleeve is provided with a slot for the buckle to be exposed.

* * * * *